US010188934B2

(12) United States Patent
Chartrand et al.

(10) Patent No.: US 10,188,934 B2
(45) Date of Patent: Jan. 29, 2019

(54) ICE SKATE AND RUNNER THEREFOR

(71) Applicant: SPORT MASKA INC., Montreal (CA)

(72) Inventors: Daniel Chartrand, Lorraine (CA); Bernard Daoust, Sutton (CA)

(73) Assignee: SPORT MASKA INC., Montreal, Quebec ( * ) Notice: Subject to any disclaimer, the term of this patent is extended or adjusted under 35 U.S.C. 154(b) by 0 days.

(21) Appl. No.: 15/624,019

(22) Filed: Jun. 15, 2017

(65) Prior Publication Data

US 2017/0361200 A1 Dec. 21, 2017

Related U.S. Application Data

(60) Provisional application No. 62/350,359, filed on Jun. 15, 2016.

(51) Int. Cl.

| | |
|---|---|
| ***A63C 1/32*** | (2006.01) |
| ***A63C 1/30*** | (2006.01) |
| ***A63C 1/42*** | (2006.01) |

(52) U.S. Cl.

CPC ..... *A63C 1/32* (2013.01); *A63C 1/303* (2013.01); *A63C 1/42* (2013.01)

(58) Field of Classification Search

CPC ..... A63C 1/32; A63C 1/42; A63C 1/303

See application file for complete search history.

(56) References Cited

U.S. PATENT DOCUMENTS

| | | | | | |
|---|---|---|---|---|---|
| 1,115,790 | A | * | 11/1914 | Drevitson | A63C 1/42 164/111 |
| 2,108,128 | A | * | 2/1938 | Kinney | A63C 3/12 280/11.18 |
| 3,074,733 | A | * | 1/1963 | Norgiel | A63C 1/10 280/11.18 |
| 3,212,786 | A | * | 10/1965 | Schmitt | A63C 1/30 280/11.12 |
| 4,131,288 | A | * | 12/1978 | Wilson | A63C 1/30 280/11.12 |
| 4,223,900 | A | * | 9/1980 | Olivieri | A63C 1/32 280/11.12 |
| 4,314,708 | A | * | 2/1982 | Zuuring | A63C 1/32 280/11.18 |
| 4,336,948 | A | * | 6/1982 | Couture | A63C 1/42 264/273 |
| 4,907,813 | A | * | 3/1990 | Hall | A63C 1/32 280/11.18 |
| 5,354,078 | A | * | 10/1994 | Bellelsle | A63C 1/30 280/11.18 |

(Continued)

*Primary Examiner* — Jacob B Meyer

(74) *Attorney, Agent, or Firm* — Norton Rose Fulbright Canada

(57) ABSTRACT

A runner for an ice skate. The runner extends along a longitudinal axis between a front end and an opposed rear end. The runner is entirely metal and has a height extending between an ice-contacting portion for engaging an ice surface and an opposed upper portion. The runner has a datum runner thickness defined between outer and inner side surfaces of the runner. The runner has one or more regions of reduced thickness that are recessed inwardly from one or both of the outer and inner surfaces. The regions have a local thickness being less than the datum runner thickness. An ice skate and method of making a runner for an ice skate are also disclosed.

17 Claims, 4 Drawing Sheets

(56) References Cited

U.S. PATENT DOCUMENTS 5,484,148 A * 1/1996 Olivieri ..... A63C 1/30 280/11.17
5,826,890 A * 10/1998 Swande ..... A63C 1/32 280/11.18
6,523,835 B1 * 2/2003 Lyden ..... A63C 1/30 280/11.12
6,761,363 B2 * 7/2004 Fask ..... A63C 1/32 280/11.12
6,830,251 B2 * 12/2004 Titzmann ..... A63C 1/32 280/11.12
7,234,709 B2 * 6/2007 Lambert ..... A63C 1/30 280/11.12
7,243,924 B2 * 7/2007 Dahlo ..... A63C 1/32 280/11.12
7,380,801 B2 * 6/2008 Rudolph ..... A63C 1/40 280/11.12
7,387,302 B2 * 6/2008 Goldsmith ..... A63C 1/00 280/11.12
7,673,884 B2 * 3/2010 Wuerthner ..... A63C 1/32 280/11.12
7,866,675 B2 * 1/2011 Hauser ..... A63C 1/303 280/11.12
7,896,363 B2 * 3/2011 Lovejoy ..... A43B 5/1641 280/11.12
7,950,676 B2 * 5/2011 Goldsmith ..... A43B 5/1625 280/11.12
8,056,907 B2 * 11/2011 Wilson ..... B24B 3/003 280/11.12
RE44,805 E * 3/2014 Dahlo ..... A63C 1/32 280/11.12
8,844,945 B2 * 9/2014 Koyess ..... A63C 1/32 280/11.12
9,186,569 B2 * 11/2015 Wuerthner ..... A63C 1/303
9,433,851 B2 * 9/2016 Dahlo ..... A63C 1/32
9,873,032 B2 * 1/2018 Makai ..... A63C 1/34
9,937,406 B2 * 4/2018 Dahlo ..... A63C 1/32
2001/0052678 A1 * 12/2001 Titzmann ..... A63C 1/32 280/11.18
2002/0039659 A1 * 4/2002 Abkowitz ..... A63C 1/30 428/472
2002/0056972 A1 * 5/2002 Fask ..... A63C 1/32 280/607
2002/0190487 A1 * 12/2002 Blankenburg ..... A63C 1/16 280/11.12
2003/0234499 A1 * 12/2003 Rudolph ..... A63C 1/40 280/11.17
2004/0100042 A1 * 5/2004 Lambert ..... A63C 1/30 280/11.18
2005/0029755 A1 * 2/2005 Fask ..... A63C 1/32 280/11.18
2006/0043686 A1 * 3/2006 Rudolph ..... A63C 1/40 280/11.18
2006/0103084 A1 * 5/2006 Dahlo ..... A63C 1/32 280/11.12
2007/0013152 A1 * 1/2007 Goldsmith ..... A63C 1/00 280/11.18
2008/0100008 A1 * 5/2008 Wan ..... A63C 1/30 280/11.18
2008/0150242 A1 * 6/2008 Wurthner ..... A63C 1/32 280/11.18
2008/0231008 A1 * 9/2008 Rudollph ..... A63C 1/40 280/11.18
2009/0206562 A1 * 8/2009 Podolsky ..... A63C 1/02 280/11.14
2009/0206563 A1 * 8/2009 Ferras ..... A63C 1/32 280/11.18
2009/0273148 A1 * 11/2009 Wan ..... A63C 1/32 280/11.18
2009/0289427 A1 * 11/2009 Lovejoy ..... A43B 5/1641 280/11.12
2011/0001297 A1 * 1/2011 Labonte ..... A63C 1/32 280/11.12
2013/0093150 A1 * 4/2013 Dahlo ..... A63C 1/303 280/11.18
2014/0225337 A1 * 8/2014 Olson ..... A63C 1/32 280/11.18
2014/0284890 A1 * 9/2014 Wuerthner ..... A63C 1/303 280/11.12
2014/0327217 A1 * 11/2014 Pokupec ..... A63C 1/32 280/11.18
2016/0059107 A1 * 3/2016 Finley ..... A63C 1/32 280/11.18
2016/0256765 A1 * 9/2016 Dahlo ..... A63C 1/303
2017/0165558 A1 * 6/2017 Makai ..... A63C 1/32
2017/0361200 A1 * 12/2017 Chartrand ..... A63C 1/303

* cited by examiner

ICE SKATE AND RUNNER THEREFOR

CROSS-REFERENCE TO RELATED APPLICATIONS

This application claims priority to U.S. patent application No. 62/350,359 filed Jun. 15, 2016, the entire contents of which are incorporated herein by reference.

TECHNICAL FIELD

The application relates generally to ice skates and, more particularly, to blades for ice skates.

BACKGROUND

Ice skates have metal blades fastened to a sole of the skate boot. These blades are often referred to as "runners". Some ice skates have metal runners attached to a blade holder, which is itself attached to the sole of the skate boot. It is often desired to enable the runner to be removable, in order to permit replacement of the runner because of damages or wear due to sharpening, use, etc.

Typically, such removable runners are composed of a stamped steel blade. In order to reduce the overall weight of ice skates, attempts have been made to reduce the weight of the runners. Accordingly, runners were developed which were made thinner (i.e. in a vertical direction extending between the ice and the sole of the skate boot) or otherwise minimized in comparison with traditional full metal blades. However, in order to provide sufficient strength and stiffness to the runner, such minimized runners often needed to be reinforced by a lighter weight material. This lighter material is typically plastic, which is over-molded over the metal portion of the runner, and which together then form a removable runner for the ice skate. These dual-material runners (i.e. stamped metal runner and over-molded plastic reinforcement portion) often may not allow available sharpening methods for standard runners to be used.

SUMMARY

In one aspect, there is accordingly provided an ice skate comprising: a boot adapted for receiving therein a foot of a wearer of the skate; a holder mounted to a sole of the boot and having at least one attachment point thereon; and a runner mounted to the holder and secured in place thereon via the at least one attachment point, the runner being entirely metal and extending a length along a longitudinal axis between a front end and an opposed rear end of the runner, the runner having a height extending between an ice-contacting portion for engaging an ice surface and an opposed upper portion of the runner, opposed outer and inner side surfaces of the runner defining a datum runner thickness extending therebetween, and one or more regions of reduced thickness in the runner that are recessed inwardly from at least one of the outer and inner side surfaces thereof, the one or more regions having a local thickness less than the datum runner thickness.

In another aspect, there is also provided a runner for an ice skate, comprising: a body being entirely metal and extending a length along a longitudinal axis between a front end and an opposed rear end, the body having a height extending between an ice-contacting portion for engaging an ice surface and an opposed upper portion of the body, the body having opposed outer and inner side surfaces defining a datum runner thickness extending therebetween, the body having one or more regions of reduced thickness that are recessed inwardly from at least one of the outer and inner side surfaces, the one or more regions having a local thickness being less than the datum runner thickness.

In a further aspect, there is provided a method of making a runner for an ice skate, comprising: placing a runner blank into a mold, the runner blank being entirely metal; and forging the blank in the mold to form the runner and one or more regions of reduced thickness of the runner, the regions having a local thickness and a remainder of the runner having a datum thickness, the local thickness being less than the datum thickness.

BRIEF DESCRIPTION OF THE DRAWINGS

Reference is now made to the accompanying figures in which.

DETAILED DESCRIPTION

Figure 1:
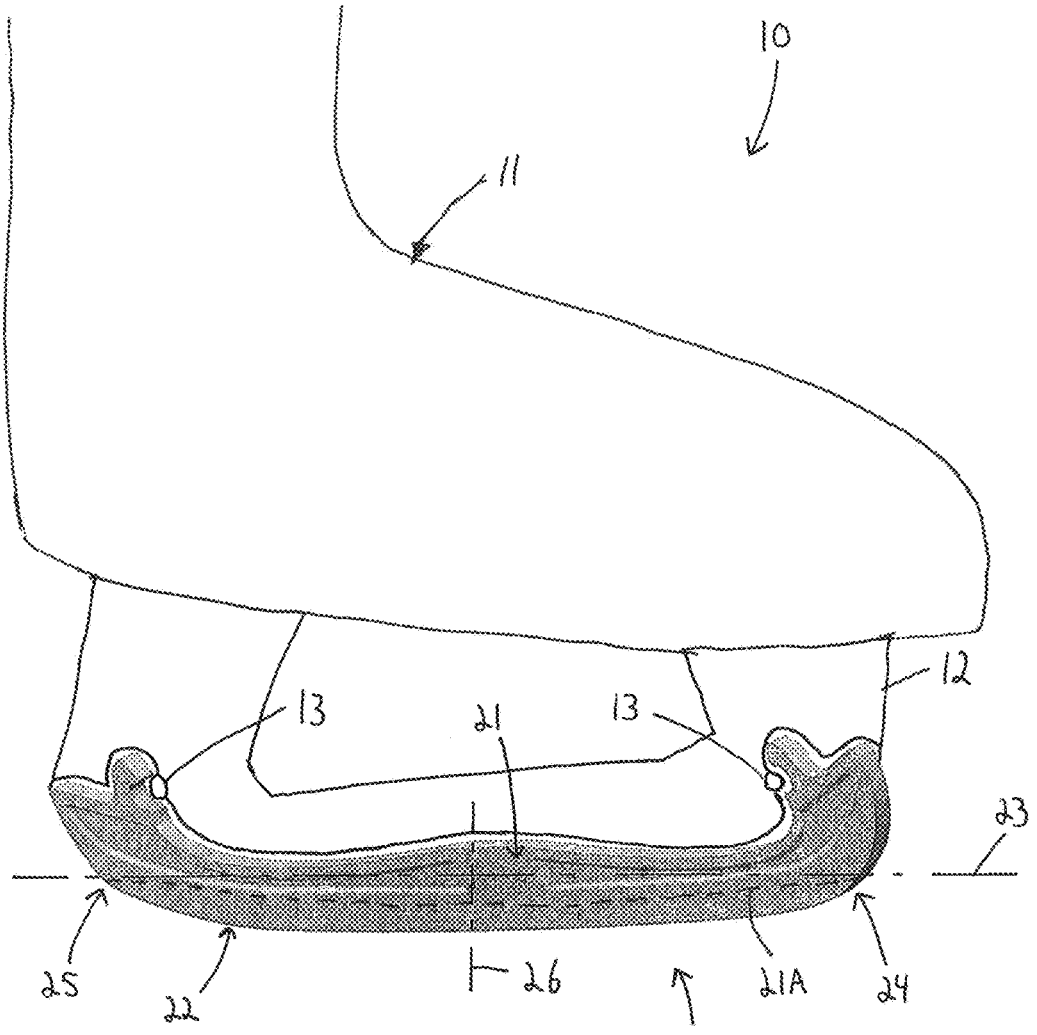
FIG. 1 is a schematic view of an ice skate having a runner, according to an embodiment of the present disclosure.

FIG. 1 illustrates an ice skate 10 for receiving therein a foot of the wearer, thereby allowing the wearer to skate along an ice surface. The ice skate 10 disclosed herein can be used during any activity on the ice surface, such as ice hockey and figure skating. The ice skate 10 (or simply "skate") has a boot 11 for receiving the foot of the wearer. Any suitable construction or configuration of the boot 11 can be used. A blade holder 12, or simply "holder", which in some embodiments is a polymeric or plastic component, is mounted to the bottom of the boot 11 and fixedly attached thereto. The holder 12 has one or more attachment points 13 which are positioned at a lower or bottom extremity of the holder 12. The one or more attachment points 13 allow a metal runner 20 (also called a "blade", but will be generally referred to herein as a "runner") to be mounted to, and may be removed from, the bottom of the holder 12. The holder 12 therefore holds the metal runner 20.

The runner 20 includes the cutting edge of the skate 10 and interacts with the ice surface to allow the wearer to glide therealong. The runner 20 of the present disclosure is composed entirely of metal, and therefore does not require any plastic or polymeric over-molded portion to provide it with the required stiffness and/or strength. In some embodiments, the runner 20 can be made entirely of a single metal material.

More particularly, the body of the fully metal runner 20 has an upper portion 21 that is mounted, via the attachment points 13, to the sole of the holder 12. The runner 20 also has a lower, ice-contacting portion 22 which engages the ice surface. The ice-contacting portion 22 can be sharpened using any suitable technique to improve its purchase with the ice surface. The maximum height or vertical extent of the ice-contacting portion 22 that can be sharpened is referred to herein as the sharpening limit 21A, which defines below it a sharpening zone of the runner 20.

The runner 20 extends along a length of the boot 11. More particularly, the runner 20 extends along a longitudinal axis 23 between a front end 24 of the runner 20, and an opposed rear end 25. A height axis 26 is transverse to the longitudinal axis 23, and defines the span, or height, of the runner 20 between the upper and ice-contacting portions 21,22. In the illustrated embodiment, the height axis 26 extends in a substantially vertical direction extending between the ice surface and the sole of the boot 11.

As noted above, the runner 20 is made entirely of metal. Stated differently, the runner 20 is composed entirely of a metal material, such as steel, and does not have another component attached thereto. Therefore, and in contrast to some other conventional runners, the runner 20 disclosed herein does not have an integrated polymer component, such as a plastic over-molding. The use of only metal to form the runner 20 simplifies the manufacturing of the runner 20, and thus, of the skate 10. In the embodiment shown, the runner 20 is made from a single metal material (e.g. steel). It will, however, be appreciated that the runner 20 can be made from a combination of two or more metal materials, and/or of alloys of one or more metals. Examples of such metal materials include amorphous metal alloys, carbon steel, titanium alloys, and silicone nitride with added stainless steel fibers.

Figure 2A:
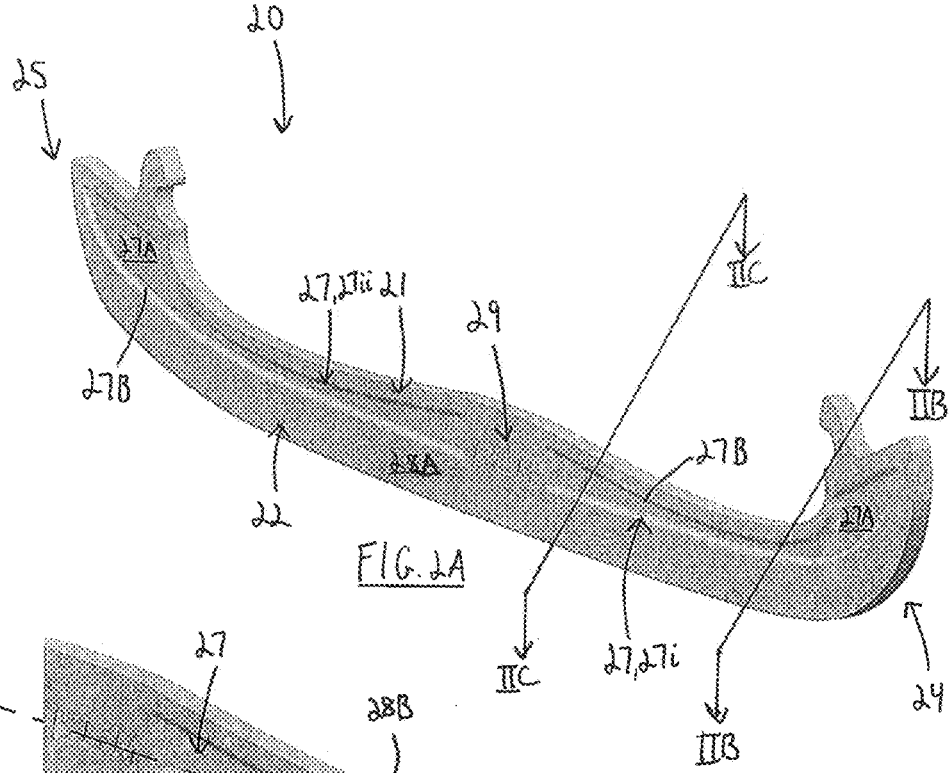
FIG. 2A is a perspective view of the runner of FIG. 1.
Figure 2B:
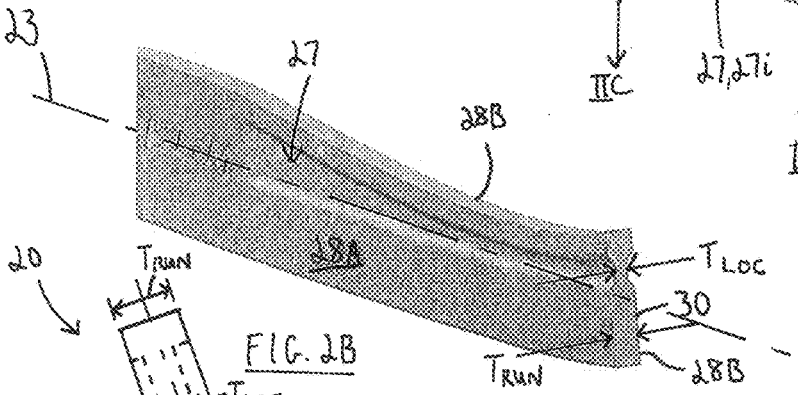
FIG. 2B is a partial perspective view of the runner of FIG. 1, showing a cross-section of the runner taken along the line IIB-IIB in FIG. 2A.
Figure 2D:
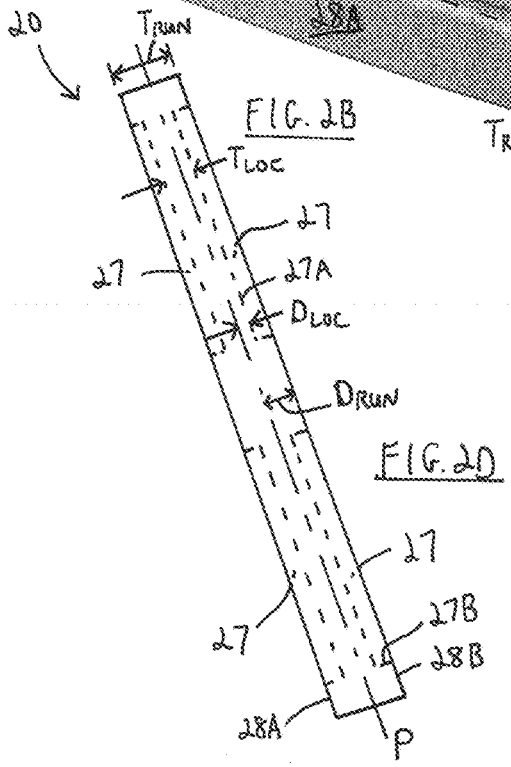
FIG. 2D is a top view of the runner of FIG. 1.
Figure 2C:
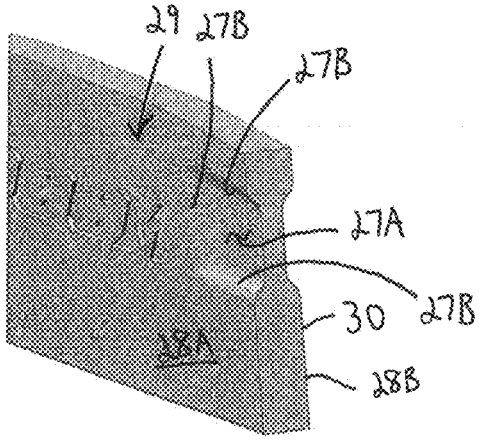
FIG. 2C is another partial perspective view of the runner of FIG. 1, showing another cross-section of the runner taken along the line IIC-IIC in FIG. 2A.

Referring now to FIGS. 2A to 2C, the runner 20 has multiple longitudinally discontinuous thin regions 27, or rather regions 27 which have a thickness that is less than the thickness of a remainder of the runner 20 and/or less than a baseline thickness as defined at the ice-contacting portion 22 of the runner 20.

The regions 27 are spaced apart along the length of the runner 20 and are not contiguous with one another. As will be explained in greater detail below, the thinner regions 27 are separated from one another by thicker regions of the runner 20 which surround some or all of the periphery of the regions 27. The regions 27 thus form portions of the runner 20 that have reduced thickness and which are made of the same material as the rest of the runner 20. In the embodiment shown, each of the regions 27 is solid and continuous along its extent. Stated differently, each of the regions 27 in the illustrated embodiment does not have holes, apertures, or interruptions therein.

The regions 27 form isolated pockets, or grooves, in the illustrated embodiment, that are thinner than the remainder of the runner 20, and that are recessed inwardly from one of, or both, of an outer surface 28A and an inner surface 28B of the runner 20. As will be explained in greater detail below, the inward spacing of the regions 27 from the outer and/or inner surfaces 28A,28B can take different forms. In the depicted embodiment, each region 27 has a bottom surface 27A which is spaced inwardly from the outer surface 28A. Inwardly-extending walls 27B extend between the outer surface 28A and the bottom surface 27A of the region 27. Other configurations for the regions 27 are within the scope of the present disclosure, as described below.

In the depicted embodiment of FIGS. 2A to 2C, the runner 20 has two regions 27, and it will be appreciated that more regions 27 are within the scope of the present disclosure. Similarly, the regions 27 are disposed on both surfaces 28A,28B of the runner 20. It will be appreciated that the regions 20 can also be disposed on only one surface 28A, 28B of the runner 20. Similarly, the number, arrangement, and/or extent of the regions 27 can be different from one surface 28A,28B of the runner 20 to the other.

Referring to FIG. 2B, each region 27 of the runner 20 has a local thickness $T_{LOC}$. The runner 20 has a datum runner thickness $T_{RUN}$, which is the thickness of runner in the areas of the runner 20 which border the regions 27. The datum runner thickness $T_{RUN}$ is a baseline thickness of the runner 20 against which can be compared the local thickness $T_{LOC}$. In the depicted embodiment, the datum runner thickness $T_{RUN}$ is defined between the outer and inner surfaces 28A, 28B of the runner 20. In the depicted embodiment, it remains constant throughout the length of the runner 20. In an alternate embodiment, the datum runner thickness $T_{RUN}$ varies and is not constant throughout the length of the runner 20. The local and datum runner thicknesses $T_{LOC}$,$T_{RUN}$ at any point along the length of the runner 20 are measured in a local plane at that point of the runner. The local plane is transverse to the longitudinal axis 23 of the runner 20. In the depicted embodiment, the local plane is perpendicular to the longitudinal axis 23 of the runner 20.

The datum runner thickness $T_{RUN}$ is greater than the local thickness $T_{LOC}$. Stated differently, and as previously explained, the regions 27 have a thickness that is less than the thickness of the remainder of the runner 20. It can thus be appreciated that the thickness of the runner 20 varies along a length thereof between the front and rear ends 24,25. This allows for the thickness of the runner 20, and thus its strength and/or stiffness, to be modified as desired. For example, in areas of the runner 20 where there is not expected to be significant loading, such as near its front and rear ends 24,25, or along the upper portion 21, the thickness of the runner 20 can be reduced by introducing the regions 27 of reduced thickness. Similarly, in areas of the runner 20 where there is expected to be more significant loading, such as along the ice-contacting portion 22, the thickness of the runner 20 can be maintained by not introducing the regions 27 of reduced thickness. Maintaining a thicker ice-contacting portion 22 also allows the runner 20 to remain fully compatible with existing sharpening equipment.

This allows the design of runner 20 to be optimised by reducing the weight of the runner 20 in the regions 27 of reduced thickness, while not comprising the strength and/or stiffness of the runner 20. This contrasts with some conventional runner designs, which have thinner portions where material has been removed by machining to achieve weight savings. The thinner portions of these conventionally-machined runners are typically less strong and/or stiff, and thus require an over-molded plastic runner portion that acts to reinforce the runner in these thinner portions. Stated differently, the weakness of these conventional runners is partly compensated by the reinforcing plastic or added lighter metal component rather than from the metal runner itself.

In the embodiment of FIG. 2A, the regions 27 include a front region 27and a rear region 27*ii*. The front region 27*i* extends along the upper portion 21 of the runner 20 between the front end 24 and a longitudinal midpoint region 29. The midpoint region 29 corresponds to the longitudinal center or middle of the runner 20, and is substantially equidistantly spaced from the front and rear ends 24,25. The rear region 27*ii* extends along the upper portion 21 between the midpoint region 29 and the rear end 25. The datum runner thickness $T_{RUN}$ at the midpoint region 29 is greater than the local thickness $T_{LOC}$ of the front and rear regions 27*i*,27*ii*. It can thus be appreciated that the runner 20 in the depicted embodiment is thicker at its midpoint region 29 than at its front and rear ends 24,25. It is anticipated that loads will be higher at the midpoint region 29 than at the front and rear ends 24,25. The runner 20 may therefore require additional thickness, and thus strength and/or stiffness, at this location.

In the depicted embodiment of FIGS. 2A to 2C, the cross-sectional profile 30 of the runner 20 at a point along the length of the runner 20 is different from the cross-sectional profile 30 at another point along the length of the runner 20. Each cross-sectional profile 30 is defined in a plane that is transverse to the longitudinal axis 23. In the depicted embodiment, each cross-sectional profile 30 is defined in a plane that is perpendicular to the longitudinal axis 23. As such, the cross-section of the runner 20 can vary as desired by the designer. The cross-sectional profile 30 of the runner 20 can be varied, and thus optimized, as a function of the mechanical requirements imposed on and/or required by the runner 20. As will be seen herein, for example, the cross-section of the runner 20 can be varied along the length of the runner 20 in a manner such that regions of expected higher loads (such as a longitudinal midpoint region 29, for example) can be made thicker, while other regions of expected lower loads can be made thinner. The runner designer may also vary the cross-sectional profile 30 based on player preferences, such that different players can choose runners 20 with varying properties to suit their desired performance.

In FIG. 2B, the cross-sectional profile 30 is taken at a location of the runner 20 adjacent to its front end 24, along the line IIB-IIB in FIG. 2A. As can be seen, the cross-sectional profile 30 has an "hour-glass" shape. In FIG. 2C, the cross-sectional profile 30 is taken at a location of the runner 20 adjacent to its midpoint region 29, along the line IIC-IIC in FIG. 2A. As can be seen, the cross-sectional profile 30 also has an "hour-glass" shape. The hour-glass shape in FIG. 2C is different from that in FIG. 2B. It can thus be appreciated that the cross-sectional profile 30 of the runner 20 is not constant along its length.

FIG. 2D shows the regions 27 being recessed from both of the outer and inner surfaces 28A,28B of the runner 20. The longitudinal axis 23 in FIG. 2D extends through the center of the runner 20 and lies in a center plane P. Each of regions 27 extends inwardly from one of the outer and inner surfaces 28A,28B toward the center plane P extending through the center of the runner 20. A distance $D_{RUN}$ is defined between the outer and inner surfaces 28A,28B and the center plane P. The distance $D_{RUN}$ is greater than a distance $D_{LOC}$ which is defined between the bottom surface 27A and the center plane P. The datum runner thickness $T_{RUN}$, being defined between the outer and inner surfaces 28A,28B, is greater than the local thickness $T_{LOC}$.

In FIGS. 2A to 2D, each region 27*i*,27*ii* has the same local thickness $T_{LOC}$. In an alternate embodiment, the local thickness $T_{LOC}$ of one of the regions 27 may differ from the local thickness $T_{LOC}$ of one or more of the other regions 27. The runner 20 in such a configuration therefore has regions 27 with thinner (and thus non-constant) thickness.

Figure 3A:
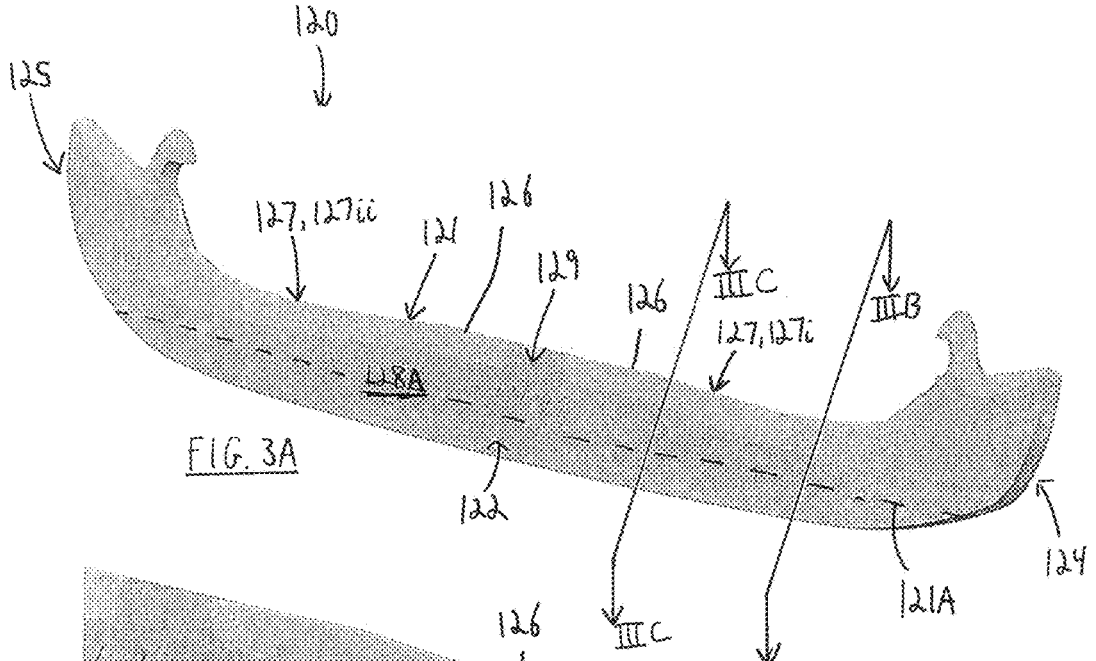
FIG. 3A is a perspective view of a runner for an ice skate, according to another embodiment of the present disclosure.
Figure 3B:
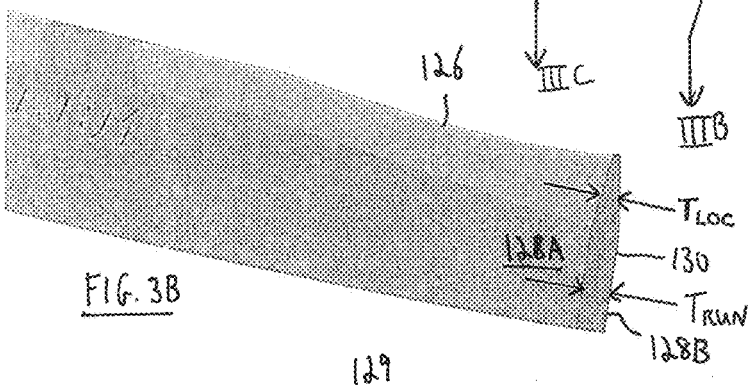
FIG. 3B is a partial perspective view of the runner of FIG. 3A, showing a cross-section of the runner taken along the line IIIB-IIIB.
Figure 3C:
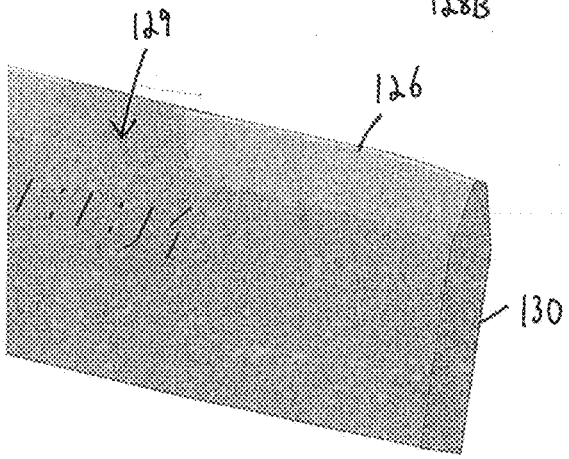
FIG. 3C is another partial perspective view of the runner of FIG. 3A, showing another cross-section of the runner taken along the line IIIC-IIIC.

FIGS. 3A to 3C show another embodiment of the runner 120. The runner 120 also has multiple longitudinally discontinuous thinner regions 127. In the depicted embodiment, each region 127 is recessed from the outer and/or inners surfaces 128A,128B by sloping inwardly therefrom. More particularly, each region 127 slopes inwardly from the outer surface 128A toward an upper extremity 126 of the runner 120. The datum runner thickness $T_{RUN}$ is greater than the local thickness $T_{LOC}$ of the regions 127. Referring to FIG. 3A, the regions 127 include a front region 127*i* and a rear region 127*ii*. The front region 127*i* extends along the upper portion 121 of the runner 120 between the front end 124 and the longitudinal midpoint region 129. The rear region 127*ii* extends along the upper portion 121 between the midpoint region 129 and the rear end 125. The datum runner thickness $T_{RUN}$ at the midpoint region 129 is greater than the local thickness $T_{LOC}$ of the front and rear regions 127*i*,127*ii*.

In the embodiment of FIGS. 3B and 3C, the cross-sectional profile 130 of the runner 120 also varies along its length. Referring to FIG. 3B, the cross-sectional profile 130 is taken at a point on the runner 120 adjacent to its front end 124, along the line IIIB-IIIB of FIG. 3A. As can be seen, the cross-sectional profile 130 has a "house" shape. Referring to FIG. 3C, the cross-sectional profile 130 is taken at a point on the runner 120 adjacent to its midpoint region 129, along the line IIIC-IIIC of FIG. 3A. As can be seen, the cross-sectional profile 130 also has a "house" shape. The house shape in FIG. 3C is different from that in FIG. 3B. It can thus be appreciated that the cross-sectional profile 130 of the runner 120 is not constant along its length.

Still referring to FIGS. 3A to 3C, the regions 127 are disposed along only the upper portion 121 of the runner 120. The datum runner thickness $T_{RUN}$ along the ice-contacting portion 122 of the runner 120 is greater than the local thickness $T_{LOC}$ of the regions 127 disposed along the upper portion 121. The depicted embodiment of the runner 120 is thus thicker near its glide, or ice-contacting portion 122, which is the area of the runner 120 which contacts the ice surface and which is periodically sharpened. The runner 120 therefore has regions 127 of reduced thickness upward of the sharpening limit 121A.

Figure 4:
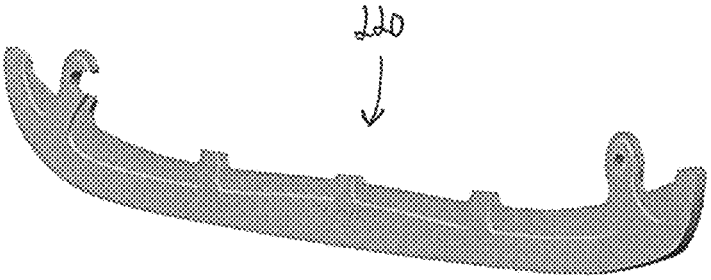
FIG. 4 is a perspective view of a runner for an ice skate, in accordance with another alternate embodiment of the present disclosure.
Figure 5:
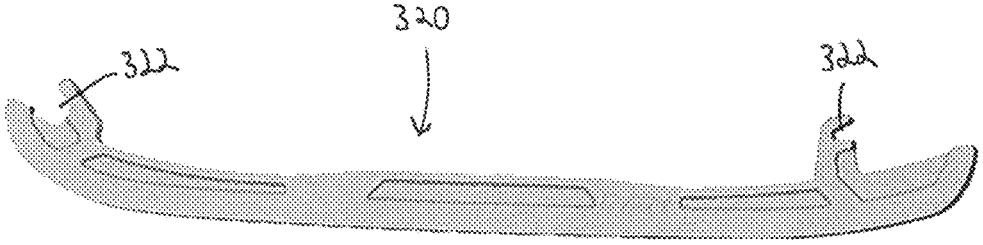
FIG. 5 is a perspective view of a runner for an ice skate, in accordance with yet a further alternate embodiment of the present disclosure.
Figure 6:
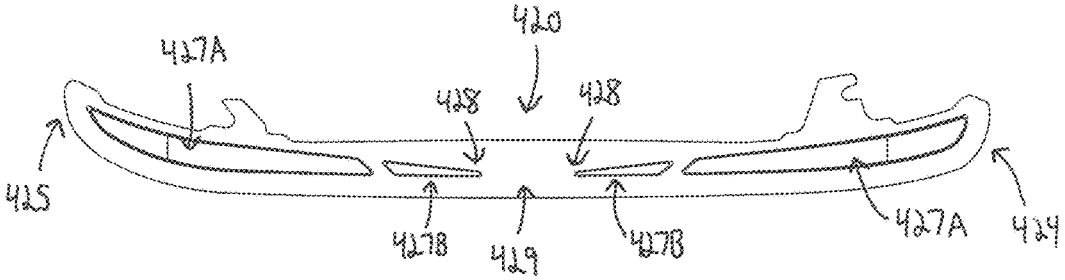
FIG. 6 is a perspective view of a runner for an ice skate, in accordance with yet a further alternate embodiment of the present disclosure.

Referring now to FIGS. 4 to 6, runners 220,320,420 in accordance with alternate embodiments of the present disclosure are shown. Although their particular configurations differ somewhat from the runners 20 and 120 as described above, the features described with respect to the runners 20 and 120 similarly apply to the alternate runners 220,320,420 of FIGS. 4 to 6. The runners 220,320,420 are similarly entirely metal, forged runners that have multiple longitudinally discontinuous thin regions 27 having a reduced cross-section in comparison with the remainder of the runner 220,320,420 outside these thinner regions 27. The runner 220 of FIG. 4 is designed to be received within a standard stake blade holder. The runner 320 of FIG. 5 is designed to be received within a quick-release blade holder. As such, the upstanding attachment lugs of the runner 320 includes opened perimeter openings 322 which are intended to mate with attachment elements of the blade holder, thereby permitting the runner 320 to be quickly (i.e. without having to unscrew a bolt or other threaded fastener, etc.) removed from the holder when necessary.

The runner 420 shown in FIG. 6 has four regions 427 of reduced thickness. The runner 420 has two outer regions 427A, each disposed adjacent to one of the front and rear ends 424,425 of the runner 420. The runner also has two inner regions 427B disposed inwardly of the outer regions 427A, and on opposite sides of the midpoint portion 429 of the runner 420. Each of the inner regions 427B has a substantially triangular shape. A narrowest portion of each triangular inner region 427B forms an apex 428 that points towards, and is closer to, the midpoint region 429 of the runner 420. The apex 428 of each triangular inner region 427B point toward one another. The widest portion of each triangular inner region 427B is adjacent to one of the front and rear ends 424,425 of the runner 420. Each triangular inner region 427B therefore increases in height along a direction from the midpoint region 429 to the extremities of the runner (i.e. towards the front and rear ends 424,425). The triangular configuration of the inner regions 427B reduces the size of the inner regions 427B of reduced thickness in the vicinity of the midpoint region 429 of the runner 420, thereby allowing the runner 429 to remain thicker at the midpoint region 429 which may be a region of loading on the runner 420. This may improve the bend resistance of the runner 420 at the midpoint region 429, where the bend resistance may need to be at its maximum.

Referring back to FIGS. 2A to 2C, there is also disclosed a method of making a runner 20 for an ice skate. In an optional embodiment, the method includes identifying regions 27 of the runner 20 that have reduced thickness. This can include identifying regions of higher loading on the runner 20. These higher loading regions correspond to the areas of the runner 20 that border the regions 27 of reduced thickness. This allows for optimising the runner 20 to have increased thickness, strength, and/or stiffness in the regions of high loading, while being thinner elsewhere.

The method also includes placing an entirely metal runner blank into a mold. The blank is a piece of metal, such as a metal sheet or a metal billet, that is to be drawn or pressed into a finished object. More particularly, the blank will be forged to form the runner 20, and can thus take different forms. For example, prior to being placed in the mold, the blank can be die-cut from a metal plate to form a rough outline of the runner 20 which has a constant thickness.

The method also includes forging the metal blank in the mold to form the runner 20, the regions 27 of reduced thickness, and the areas of the runner 20 that border the regions 27 reduced thickness. The regions 27 of reduced thickness have a thickness that is less than a datum thickness of the remainder of the runner 20.

Forging is understood to be a manufacturing process involving the shaping of metal using localized compressive forces. Forging is often classified according to the temperature at which it is performed: cold forging, warm forging, or hot forging. As the metal is shaped during the forging process, its internal grain deforms to follow the general shape of the runner 20. As a result, the grain is continuous throughout the runner 20, which may give rise to a piece with improved strength characteristics. Forging may also allow better alignment of the grains of the metal so that they comply with the desired geometry of the runner 20 and meet local mechanical constraints.

Forging can be contrasted with other manufacturing processes, such as machining, which are employed to manufacture some conventional runners. Machining involves removing or carving out material with a milling machine, for example. This is expected to weaken the steel runner by creating ruptures in the grain flow. In contrast to machining processes, forging as disclosed herein is not expected to create ruptures. Forging can produce a piece that is stronger than an equivalent cast or machined part.

Furthermore, forging can produce a multitude of different cross-sectional profiles 30 to optimize weight and mechanical behavior, and allows for forming the skating bottom radius. In contrast, conventional stamping or rolling techniques may only achieve a linear part, and the resulting part must be bent to form the skating bottom radius.

Some of the features of the runner 20 described above can be formed during the forging of the metal blank. For example, forging the metal blank includes forming the regions 27 of reduced thickness to be discontinuous. For example, forging the metal blank includes varying a cross-sectional profile 30 of the metal blank along a length thereof between the front and rear ends 24,25.

When the metal blank is die cut before being placed in the mold, forging includes compressing an upper region of the die-cut metal blank to form the regions 27 of reduced thickness. In one possible "cold forging" technique, the die-cut metal blank is placed into a mold where it may be heated, and a press compresses an upper portion 21 of the blank located above the sharpening limit 21A to reduce the thickness, as shown in FIGS. 3A to 3B. Any excess metal that overflows from the mold can be cut to return to the original contour of the runner 20. The resulting runner 20 has top edge regions 27 of reduced thickness. The runner 20 is lighter than the original die-cut metal blank because some excess metal has been removed. Despite its lighter weight, the runner 20 has similar bending resistance and impact resistance because of the directional properties imparted to the grain in these regions 27 during forging.

In one possible "hot forging" technique, the metal blank is placed into the mold which has mold surfaces. The mold surfaces form the regions 27 of reduced thickness along an upper region 21 of the runner 20 when the metal blank is forged. Thus, the runner 20 can be made thinner in the areas outside the sharpening limit 21A. In this "hot forging" technique, the metal blank is not die-cut from a plate. Rather, a necessary amount of solid steel is put in the mold, the metal is heated, and a press compresses the metal to conform it to the mold. Any excess metal that overflows from the mold is cut to obtain the desired contour of the runner 20. The mold is configured to form the regions 27 of reduced thickness along the top of the runner 20, in the region outside of the sharpening limit 21A of the runner 20. The resulting runner 20 has regions 27 of reduced thickness upward of the sharpening limit 21A. This technique helps to form thinner regions 27 spaced from the edge. The overall runner 20 is lighter than the original metal blank but has similar bending resistance and impact resistance because of the directional properties imparted to the grain in these regions 27 during forging.

It can thus be appreciated that the method disclosed herein allows the cross-sectional profile 30 of the runner 20 to be varied along the length of the runner 20 and to be reinforced in the thinner regions 27, all without having to remove material from the runner 20 by machining. This is in contrast to some conventional techniques for forming runners, which remove material by machining, thereby causing weakness and introducing stress to the runner.

The method disclosed herein may also contribute to beneficially forming the microstructure of the runner 20. More particularly, the method may allow the grains of the metal material to be elongated and to be oriented in the direction of forging.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. An ice skate comprising:

a boot adapted for receiving therein a foot of a wearer of the skate;

a holder mounted to a sole of the boot and having at least one attachment point thereon; and a runner mounted to the holder and secured in place thereon via the at least one attachment point, the runner being entirely metal and extending a length along a longitudinal axis between a front end and an opposed rear end of the runner, the runner having a height extending between an ice-contacting portion for engaging an ice surface and an opposed upper portion of the runner, opposed outer and inner side surfaces of the runner defining a datum runner thickness extending therebetween, and one or more regions of reduced thickness in the runner that are recessed inwardly from at least one of the outer and inner side surfaces thereof, the one or more regions having a local thickness less than the datum runner thickness, at least one of the one or more regions of reduced thickness having a closed periphery being entirely surrounded by regions having a thickness greater than the local thickness.

2. The ice skate as defined in claim 1, wherein cross-sectional profiles of the runner are each defined in a plane being transverse to the longitudinal axis, at least one of the cross-sectional profiles being different from another one of the cross-sectional profiles.

3. The ice skate as defined claim 1, wherein the one or more regions of reduced thickness include a plurality of longitudinally discontinuous regions, the local thickness of one of said plurality of longitudinally discontinuous regions being different from the local thickness of at least another one of said plurality of longitudinally discontinuous regions.

4. The ice skate as defined claim 1, wherein the one or more regions of reduced thickness include a plurality of longitudinally discontinuous regions, the local thickness of each of the plurality of longitudinally discontinuous regions being the same.

5. The ice skate as defined in claim 4, wherein the plurality of longitudinally discontinuous regions includes a front region and a rear region, the front region extending along the upper portion of the runner between the front end and a longitudinal midpoint region being substantially equidistantly spaced from the front and rear ends of the runner, the rear region extending along the upper portion between the midpoint region and the rear end of the runner, the datum runner thickness at the midpoint region of the runner being greater than the local thickness of the front and rear regions.

6. The ice skate as defined in claim 4, wherein the plurality of longitudinally discontinuous regions includes two inner regions disposed on opposite sides of a longitudinal midpoint region being substantially equidistantly spaced from the front and rear ends of the runner.

7. The ice skate as defined in claim 6, wherein each inner region has a substantially triangular shape, a height of each inner region increasing in a direction away from the midpoint region and toward the front and rear ends.

8. The ice skate as defined in claim 1, wherein the one or more regions are disposed along only the upper portion of the runner above a sharpening limit of the runner, the datum runner thickness along the ice-contacting portion of the runner being greater than the local thickness of the regions disposed along the upper portion.

9. The ice skate as defined in claim 1, wherein the runner is removably secured to the holder.

10. A runner for an ice skate, comprising: a body being entirely metal and extending a length along a longitudinal axis between a front end and an opposed rear end, the body having a height extending between an ice-contacting portion for engaging an ice surface and an opposed upper portion of the body, the body having opposed outer and inner side surfaces defining a datum runner thickness extending therebetween, the body having one or more regions of reduced thickness that are recessed inwardly from at least one of the outer and inner side surfaces, the one or more regions having a local thickness being less than the datum runner thickness, at least one of the one or more regions of reduced thickness having a closed periphery being entirely surrounded by regions having a thickness greater than the local thickness.

11. The runner as defined in claim 10, wherein cross-sectional profiles of the body are each defined in a plane being transverse to the longitudinal axis, at least one of the cross-sectional profiles being different from another one of the cross-sectional profiles.

12. The runner as defined claim 10, wherein the one or more regions include a plurality of longitudinally discontinuous regions, the local thickness of each of the plurality of longitudinally discontinuous regions being the same.

13. The runner as defined in claim 12, wherein the plurality of longitudinally discontinuous regions includes a front region and a rear region, the front region extending along the upper portion of the body between the front end and a longitudinal midpoint region being substantially equidistantly spaced from the front and rear ends of the body, the rear region extending along the upper portion between the midpoint region and the rear end of the body, the datum runner thickness at the midpoint region of the body being greater than the local thickness of the front and rear regions.

14. The runner as defined in claim 10, wherein the one or more regions are disposed along only the upper portion of the body above a sharpening limit of the body, the datum runner thickness along the ice-contacting portion of the body being greater than the local thickness of the regions disposed along the upper portion.

15. The runner as defined in claim 10, wherein the entirely metal body is forged.

16. A runner for an ice skate, comprising: a body being entirely metal and extending a length along a longitudinal axis between a front end and an opposed rear end, the body having a height extending between an ice-contacting portion for engaging an ice surface and an opposed upper portion of the body, the body having opposed outer and inner side surfaces defining a datum runner thickness extending therebetween, the body having one or more regions of reduced thickness that are recessed inwardly from at least one of the outer and inner side surfaces, the one or more regions having a local thickness being less than the datum runner thickness, the one or more regions of reduced thickness including a plurality of longitudinally discontinuous regions, the local thickness of each of the plurality of longitudinally discontinuous regions being the same, the plurality of longitudinally discontinuous regions including two inner regions disposed on opposite sides of a longitudinal midpoint region being substantially equidistantly spaced from the front and rear ends of the runner, at least the two inner regions having a closed periphery entirely surrounded by regions of the body having the datum runner thickness that is greater than the local thickness, a height of each inner region increasing in a direction away from the midpoint region and toward the front and rear ends.

17. The runner as defined in claim 16, wherein each of the two inner regions has a substantially triangular shape.

* * * * *